US007607865B2

(12) United States Patent
Gregory et al.

(10) Patent No.: US 7,607,865 B2
(45) **Date of Patent: *Oct. 27, 2009**

(54) SYSTEM AND METHOD FOR RAISING AND SUPPORTING A BUILDING AND CONNECTING ELONGATED PILING SECTIONS

(75) Inventors: Steven D. Gregory, Plano, TX (US); Darren Gregory, Ada, OK (US); Robert Kent Pharr, Stonewall, OK (US)

(73) Assignee: Gregory Enterprises, Inc., Garland, TX (US)

( * ) Notice: Subject to any disclaimer, the term of this patent is extended or adjusted under 35 U.S.C. 154(b) by 357 days.

This patent is subject to a terminal disclaimer.

(21) Appl. No.: 11/397,463

(22) Filed: Apr. 4, 2006

(65) Prior Publication Data

US 2007/0231080 A1 Oct. 4, 2007

(51) Int. Cl.
*E02D 5/74* (2006.01)

(52) U.S. Cl. ..... 405/251; 405/253; 52/296; 403/296; 403/299

(58) Field of Classification Search ..... 405/229–232, 405/249–251, 252.1, 253; 403/296, 299; 285/185

See application file for complete search history.

(56) References Cited

U.S. PATENT DOCUMENTS

| | | | |
|---|---|---|---|
| 4,673,315 | A | 6/1987 | Shaw et al. |
| 4,694,625 | A | 9/1987 | Gregory |
| 4,695,203 | A | 9/1987 | Gregory |
| 4,754,588 | A | 7/1988 | Gregory |
| 4,765,777 | A | 8/1988 | Gregory |
| 4,878,781 | A | 11/1989 | Gregory et al. |
| 4,911,580 | A | 3/1990 | Gregory et al. |
| 5,722,798 | A | 3/1998 | Gregory |
| 5,951,206 | A | 9/1999 | Gregory |
| 6,468,002 | B1 | 10/2002 | Gregory et al. |
| 6,514,012 | B2 | 2/2003 | Gregory et al. |
| 6,931,805 | B2 | 8/2005 | Gregory et al. |
| 7,024,827 | B2 | 4/2006 | Gregory et al. |
| 7,073,296 | B2 | 7/2006 | Gregory et al. |

*Primary Examiner*—Tara Mayo-Pinnock
(74) *Attorney, Agent, or Firm*—Haynes and Boone, LLP

(57) ABSTRACT

A system and method for supporting a building in which elongated sections, such as pilings, are connected in an end-to-end, abutting relationship.

11 Claims, 5 Drawing Sheets

SYSTEM AND METHOD FOR RAISING AND SUPPORTING A BUILDING AND CONNECTING ELONGATED PILING SECTIONS

BACKGROUND

This invention relates to a system and method for supporting a building and, more particularly, to such a system and method in which elongated sections, such as pilings, conduits, and the like, are connected in an end-to-end, abutting, relationship.

DETAILED DESCRIPTION

Figure 1:
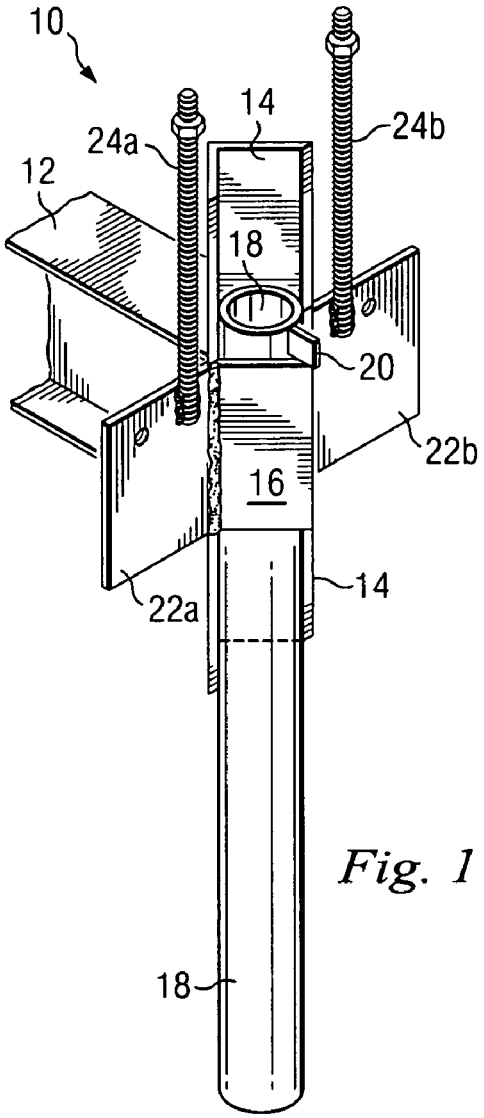
FIGS. 1-3 are isometric views depicting the raising and supporting system of the present invention in various stages of operation.

Referring specifically to FIG. 1 of the drawings, the reference numeral 10 refers, in general, to the lifting assembly of the present invention which includes a lifting arm 12, in the form of an I-beam, which extends under the foundation or slab to be lifted. A relatively long channel iron 14 is welded to one end of the lifting arm 12 and extends perpendicular thereto. A relatively short channel iron 16 is welded to the channel iron 14 along their respective corresponding longitudinal edges to define an opening for receiving a support sleeve 18. A lip 20 is welded to the upper end portion of the sleeve 18 which engages the channel iron 16 to maintain the sleeve in the position shown with the upper end portion extending slightly above the channel irons 14 and 16, for reasons to be explained.

A pair of mounting plates 22*a* and 22*b* are welded to the respective corresponding welded edges of the channel irons 14 and 16 and each has an opening extending there through. A pair of threaded rods 24*a* and 24*b* are welded to the plates 22*a* and 22*b*, respectively, and extend upwardly therefrom for reasons to be described.

Figure 2:
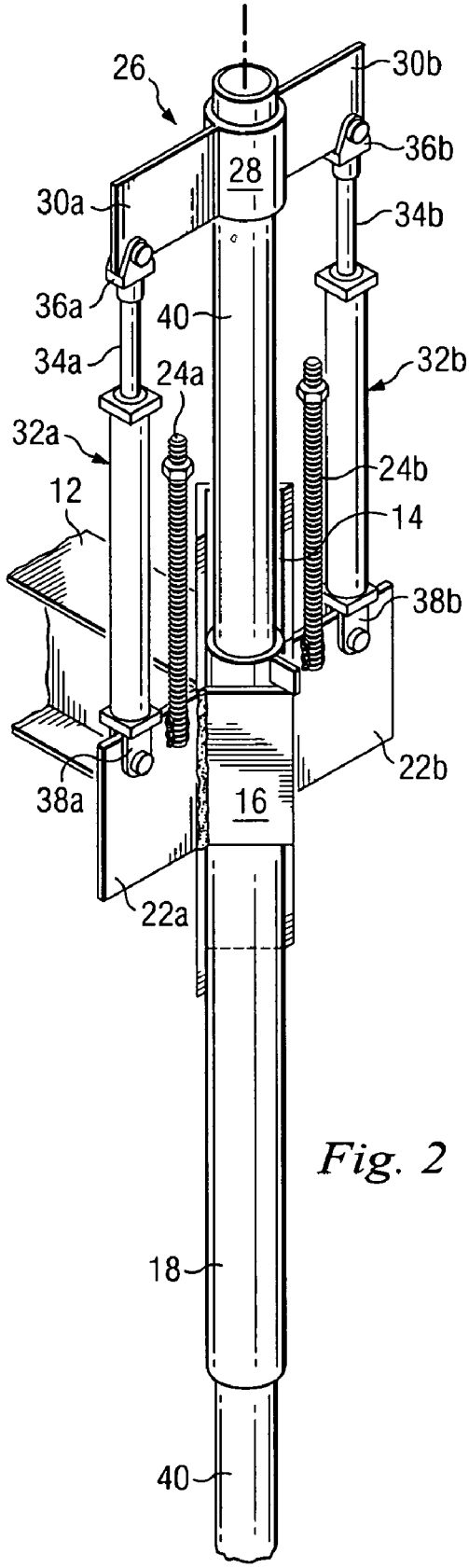

FIG. 2 depicts the apparatus of FIG. 1 with a hydraulic drive assembly mounted thereon. The reference numeral 26 refers, in general, to a driving, or clamping, assembly, which includes a gripping sleeve 28. Although not clear from the drawings, it is understood that the sleeve 28 is in the form of a conventional "slip bowl" for grabbing or clamping over a pipe and, as such, includes three inner arcuate inserts (not shown) which are tapered in a vertical direction so that they will grab, or clamp, a pipe segment of a predetermined diameter during downward movement, and slide over the pipe segment during upward movement, in a conventional manner. A pair of mounting plates 30*a* and 30*b* are connected to, and extend from, diametrically opposite portions of the sleeve 28 and each has an opening extending there through. This clamping assembly 26 is disclosed in more detail in applicant's U.S. Pat. No. 4,765,777, the disclosure of which is hereby incorporated by reference.

A pair of hydraulic ram units 32*a* and 32*b* are adapted for installation between the respective plates 22*a* and 30*a*, and the plates 22*b* and 30*b*. The ram units 32*a* and 32*b* include a pair of arms 34*a* and 34*b*, respectively, which are connected to pistons (not shown) which reciprocate in the ram units in response to actuation of the units, in a conventional manner. This reciprocal movement of the pistons causes corresponding movement of the arms 34*a* and 34*b* between the extended position shown in FIG. 2 and a retracted position.

The ram units 32*a* and 32*b* include a pair of devises 36*a* and 36*b* respectively, which are connected to the respective ends of the arms 34*a* and 34*b*. The devises 36*a* and 36*b* extend over the plates 30*a* and 30*b*, respectively, and are connected to the latter plates by a pair of bolts. In a similar manner, a pair of devises 38*a* and 38*b* are connected to the lower ends of the ram units 32*a* and 32*b*, respectively, extend over the plates 22*a* and 22*b*, and are connected to the latter plates by a pair of bolts.

The sleeve 28 of the clamping assembly 26 extends around a piling, or pipe assembly, shown in general by the reference numeral 40 which comprises a plurality of pipe segments connected together in a manner to be described. Due to the tapered configuration of the above-described arcuate inserts, the clamping assembly 26 can be manually lifted upwardly on the piling assembly 40 without encountering substantial resistance. When the hydraulic ram units 32*a* and 32*b* are then retracted, the clamping assembly 26 moves downwardly over the piling assembly 40 and the inserts grab, or clamp, the outer surface of the pipe assembly and force it downwardly, as will be described in further detail later.

To install the lifting assembly 10, the area around the foundation to be lifted is initially excavated and the lifting assembly is placed in the excavated area with the lifting arm 12 extending underneath the house (not shown) and against the lower surface of the foundation. The sleeve 18 is inserted through the opening defined by the channel irons 14 and 16 and driven into the ground until the lip 20 engages the upper end of the channel iron 16. The sleeve can be driven manually or by use of the hydraulic ram units 32*a* and 32*b* in the manner described herein.

A section of the piling assembly 40 is then placed in the sleeve 18 and the clamping assembly 26 is placed over the upper portion of the piling assembly. The hydraulic ram units 32*a* and 32*b*, in their extended positions shown in FIG. 2, are then installed between the respective plates 22*a* and 30*a* and the plates 22*b* and 30*b*, respectively.

The ram units 32*a* and 32*b* are then actuated simultaneously to cause a retracting motion of their corresponding pistons, and therefore the arms 34*a* and 34*b*, to force the clamping assembly 26 downwardly. As a result, the sleeve 28 grabs the piling assembly 40 and forces it downwardly into the ground for a predetermined distance. The ram units 32*a* and 32*b* are then simultaneously actuated back to their expanded condition, moving the clamping assembly 26 upwardly to an upper portion of the piling assembly 40, and the sequence is repeated. During this sequential driving of the piling assembly 40 into the ground, additional pipe segments may be added to the assembly 40 as needed.

It is understood that a shim (not shown) can be inserted between the side wall of the foundation and the upper end portion of the channel iron 14 as needed to stabilize and align the system during the above operation.

Figure 3:
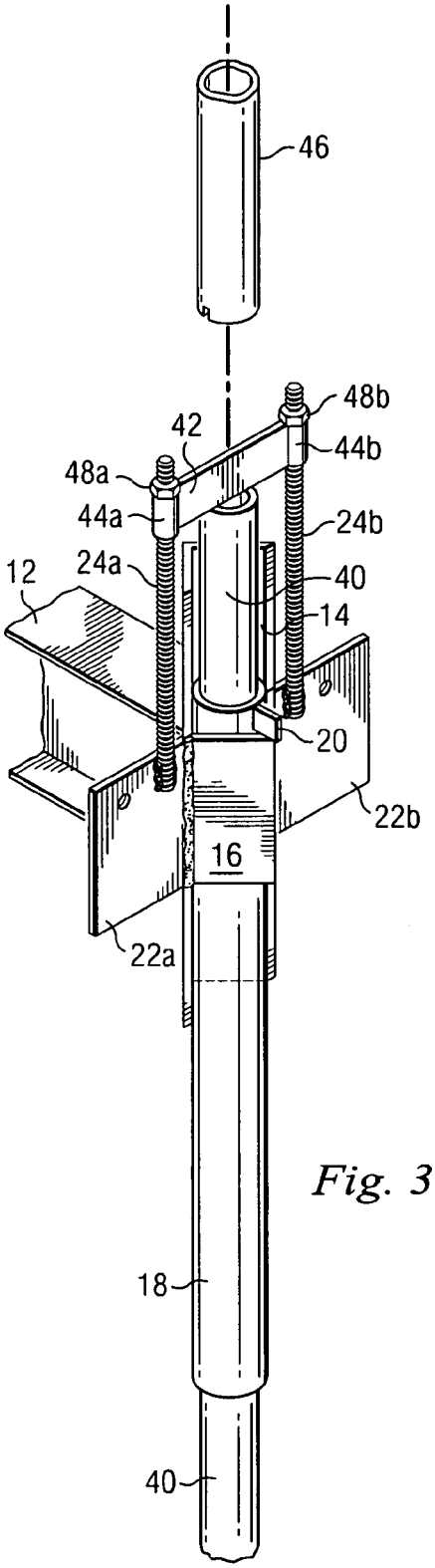
Figure 4:
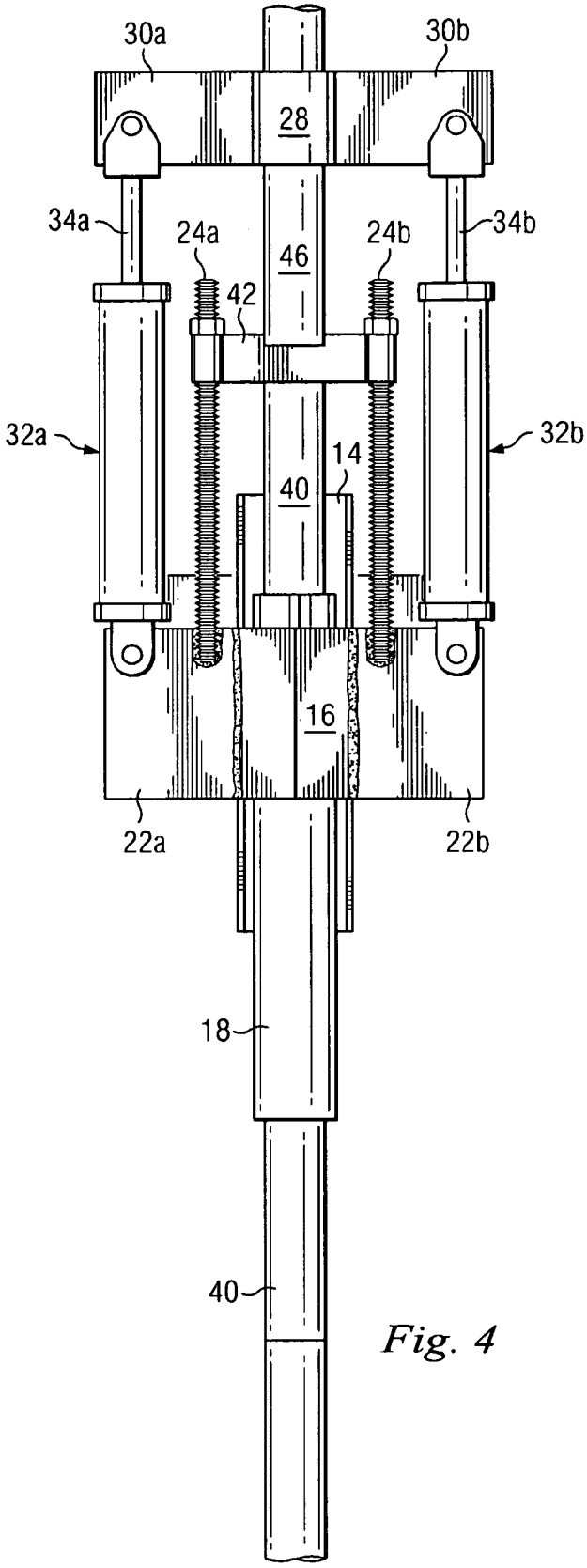
FIGS. 4 and 5 are front elevational views of the system of FIGS. 1-3 showing additional stages of operation.

The above procedure is repeated until the lower end portion of the piling assembly 40 encounters resistance in the ground, which is usually in the form of bedrock or the like, in which case the aforementioned driving movement is terminated. After resistance is encountered, the procedure depicted in FIGS. 3 and 4 is initiated. More particularly, the upper segment of the piling assembly 40 is cut off so that a few inches extend above the upper end of the sleeve 18. A drive plate 42 having two sleeves 44*a* and 44*b* at its ends is positioned over the upper piling segment with its lower edge engaging the segment and with the sleeves 44*a* and 44*b* extending over the rods 24*a* and 24*b*, respectively. A drive pipe segment 46 is then placed over the plate 42, with notches in the former extending over the upper edge of the latter.

As shown in FIG. 4 the clamping assembly 26 and the hydraulic ram units 32*a* and 32*b* are installed in the manner described in connection with FIG. 2 with the sleeve 28 extending over the pipe segment 46. The arms 34*a* and 34*b* are expanded to the extent needed for the sleeve 28 to grasp the upper end portion of the pipe segment 46.

The ram units 32*a* are then retracted to exert a vertical force against the piling assembly 40, and therefore the plate 42, and the pipe segment 46. Since the piling assembly 40 can no longer be driven downwardly, the foundation will be lifted the desired amount causing the lifting arm 12, the channel irons 14 and 16, the plates 22*a* and 22*b*, and the rods 24*a* and 24*b* to move upwardly relative to the piling assembly 40, the plate 42, and the pipe segment 46 to the position shown in FIG. 5. Thus the plate 42 is spaced from its original position on the rods 24*a* and 24*b* a distance corresponding to the distance of the lift of the foundation.

Figure 5:
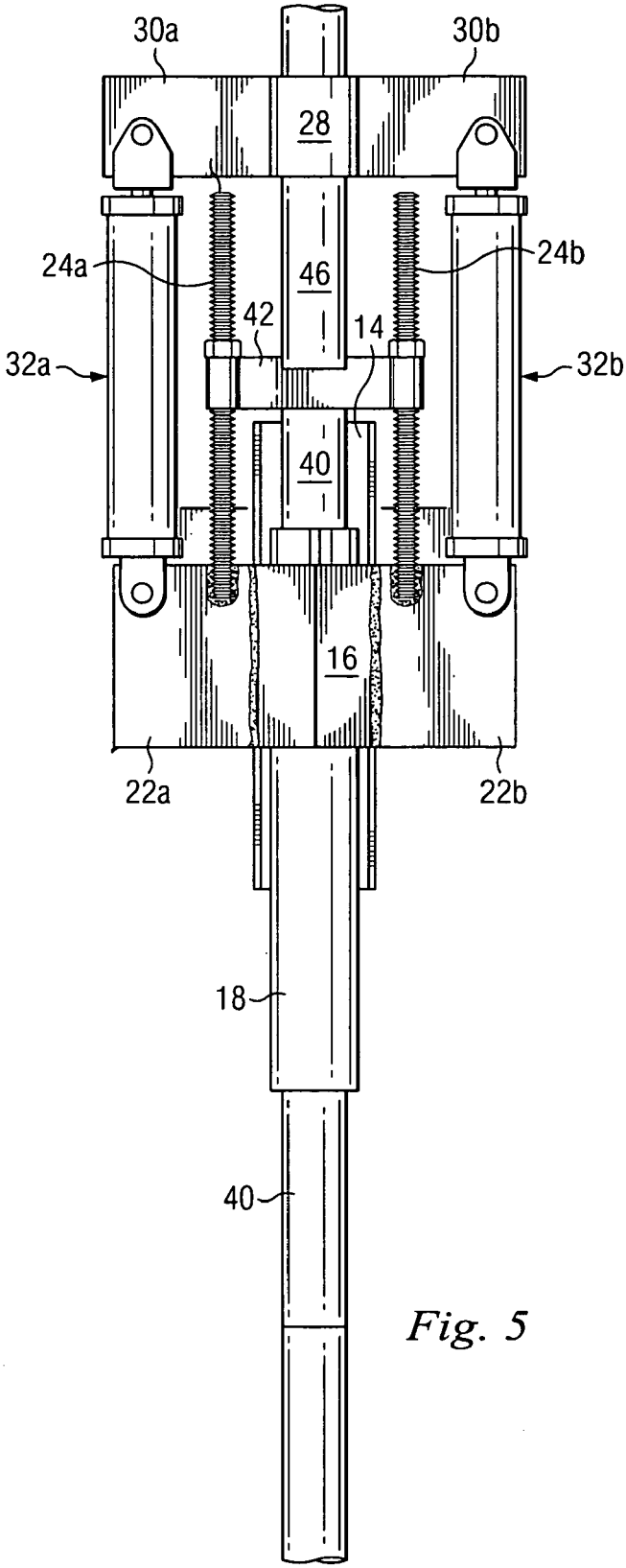

A pair of nuts 48*a* and 48*b* are then advanced downwardly over the rods 24*a* and 24*b*, respectively, until they engage the plate 42 to secure the assembly in the position of FIG. 5. The hydraulic ram units 32*a* and 32*b* along with the clamping assembly 26 and the pipe segment 46 are then removed, and the area around the assembly is filled with dirt.

Although only one lifting assembly 10 is shown in the drawing, it is understood that, in actual practice, several will be used at once at different locations along the foundation depending on the extent of the damage, in which case, after all of the piling assemblies 40 have been driven into the ground until they encounter resistance, all of the ram units 32*a* and 32*b* associated with the piling assemblies are simultaneously actuated again in the manner described in connection with FIGS. 4 and 5 to raise the foundation, and therefore the house, a predetermined distance.

Figure 6:
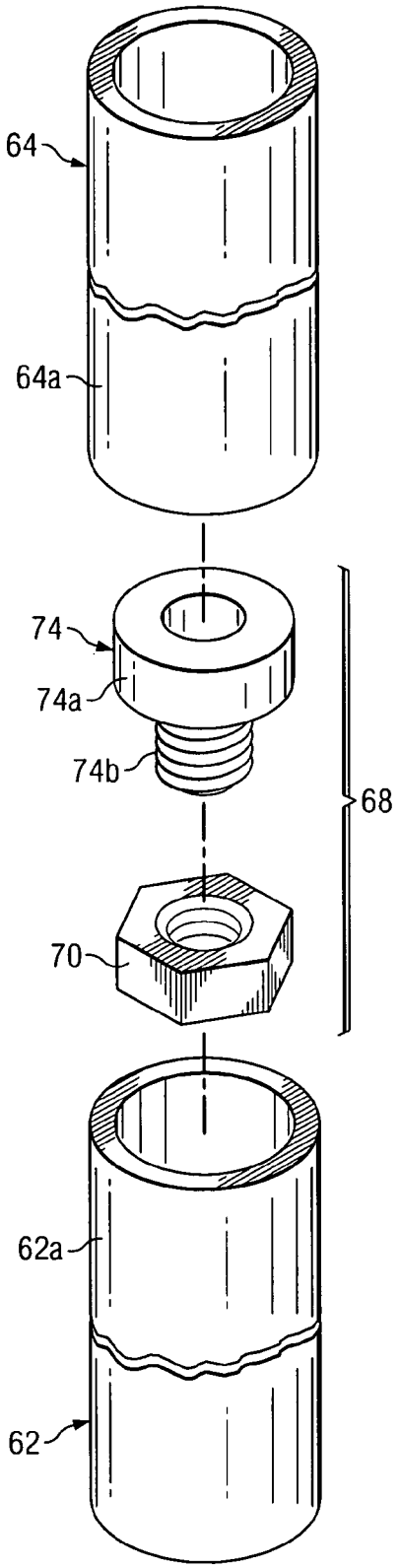
FIG. 6 is an exploded, isometric view of the connecting system according to an embodiment of the present invention shown with two elongated piling sections to be connected.

As indicated above, the piling assembly 40 can consist of two or more piling sections that are connected together. The piling sections are referred to by the reference numeral 62 and 64 in FIGS. 6-8 and are shown with a system for connecting the piling sections which system is referred to, in general, by the reference numeral 68.

Figure 8:
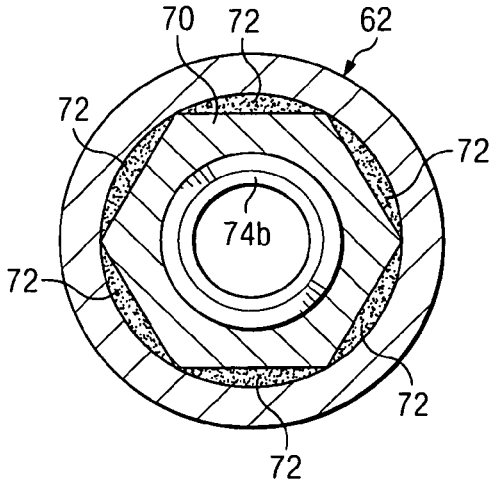
FIG. 8 is a cross-sectional view taken along the line 8-8 of FIG. 7.

The system 68 comprises a fastener 70 that is sized to extend in the end portion 62*a* of the section 62. The fastener 70 has an internally threaded bore and its outer surface is hexagonal in shape, thus forming six planar surfaces and six angles. The apexes of the angles between adjacent surfaces extend relative to the corresponding inner surfaces of the section 62 with minimal clearance, as shown in FIG. 8.

The fastener 70 can be secured in the section 62 by welding the outer planar surfaces of the fastener to the corresponding inner surfaces of the section. Due to the hexagonal outer surfaces of the fastener 70, a plurality of weldments 72 (FIG. 8) are thus formed between the latter surfaces and the corresponding inner surfaces of the sections and between the above-mentioned apexes. The outer face of the fastener 70 extends flush with the corresponding end of the section 62, as shown in FIG. 7.

The connecting assembly 68 also includes a tubular adapter 74 that has a stepped diameter to form two sections 74*a* and 74*b*. The outer diameter of the section 74*a* corresponds to the inner diameter of the piling section 64 so that it can be welded in the end portion 64*a* of the latter section. The outer diameter of the section 74*b* is threaded and sized so as to threadedly engage the internally threaded bore of the fastener 70.

Figure 7:
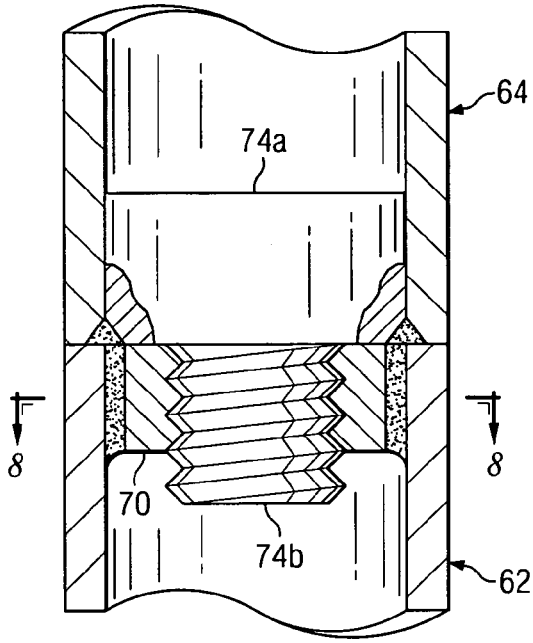
FIG. 7 is a partial, longitudinal sectional view of the system and sections of FIG. 6 shown in an assembled condition.

To assemble the sections 62 and 64 in an end-to-end abutting relationship as shown in FIG. 7, the adapter section 74*a* of the adapter 74 is welded to the inner wall of the piling section 64 as shown in FIG. 7, and the fastener 70 is welded to the inner wall of the piling section 62. Then the distal end portion of the section 74*b* of the adapter is threadedly engaged with the internally threaded bore of the fastener 70, by rotating the piling section 64, and therefore the adapter 74 relative to the piling section 62, and therefore the fastener 70, or vice versa. Thus, the adapter section 74*b* is advanced relative to the fastener 70, and therefore the piling section 62, until the distal end of the adapter 74 extends completely within the bore of the fastener 70, and the corresponding ends of the piling sections 62 and 62 are in abutment.

Figure 9:
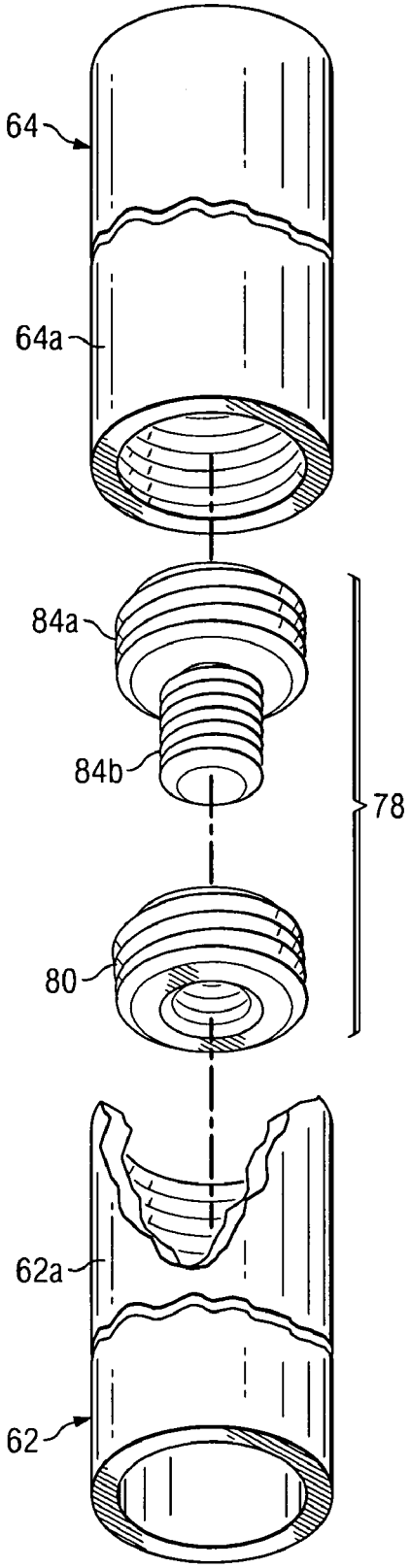
FIG. 9 is a partial elevational view of a building foundation installation utilizing the system of FIGS. 6-8.

An alternate embodiment of a connection system for connecting the piling sections 62 and 64 is shown, in general, by the reference numeral 78 in FIG. 9.

The system 78 comprises a fastener 80 that is sized to extend in the end portion 62*a* of the pipe section 62. The fastener 80 has an internally threaded bore and an externally threaded outer surface.

The inner wall of the corresponding end portion 62*a* of the pipe section 62 is internally threaded, and the fastener 80 is sized so that its external threads mate with the internal threads of the latter pipe section. Thus, the fastener 80 can be secured in the end portion 62*a* of the section 62 by simply engaging the external threads on the fastener with the internal threads on the pipe section 62 and rotating the fastener until the trailing end of the fastener extends flush with the corresponding end of the section 62.

The connecting assembly 78 also includes a tubular adapter 84 that has a stepped diameter to form two sections 84*a* and 84*b*. External threads are provided on the outer diameters of both sections 84*a* and 84*b*. The diameter of the section 84*a* is sized so as to mate with the internal threads formed in the inner wall of the end portion of the piling section 64. The diameter of the section 84*b* is sized so as to mate with the aforementioned internally threaded bore of the fastener 80.

To assemble the sections 62 and 64 in an end-to-end abutting relationship, the externally threads of the adapter section 84*a* of the adapter 84 are placed in engagement with the internal threads of the piling section 64 and the adapter is rotated relative to the piling section 64 until the entire length of the section 84*a* is in engagement with the corresponding end portion of the piling section 64. Then the external threads of the fastener 80 are placed in engagement with the internal threads of the piling section 62 and the fastener is rotated relative to the latter piling section until the entire length of the fastener is in engagement with the corresponding end portion of the piling section 62. Then the external threads of the adapter section 84*b* are placed in engagement with the internal threads of the bore of the fastener 80 and the piling section 64, and therefore the adapter 84, are rotated relative to the piling section 62, and therefore the fastener 80, or vice versa, until the corresponding end of the piling sections abut, or nearly abut.

Other examples of systems to raise and support buildings are disclosed in U.S. Pat. No. 5,951,206, U.S. Pat. No. 5,722,798, and U.S. Pat. No. 4,695,203, all assigned to the assignee of the present invention, and all of which are hereby incorporated by reference. It is understood that the connection systems 68 and 78 could be used to connect the pilings sections disclosed in each of these patents.

Figure 10:
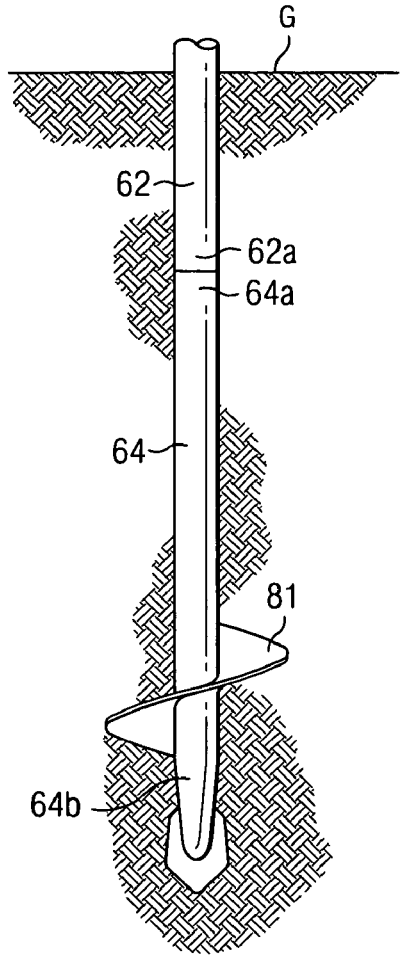
FIG. 10 is a partial elevational view illustrating an embodiment of a helix section secured to a piling section.

It is understood that the connection system 68 and/or 78 can be used to connect pilings in other types of building raising and support systems. For example, in the arrangement of FIG. 9, a building foundation support installation is depicted according to which the piling sections 62 and 64 are connected together by the system 68, or the system 78, in the manner described above. In this arrangement, at least one transversely-extending, load-bearing section, FIG. 10, in the form of a metallic helix section 81, can be secured, in any conventional manner, to the piling section 62 near its other end portion 64*b*.

The connected sections 62 and 64, and helix section 81, thus form an elongated earth screw anchor assembly that can penetrate the ground in a conventional manner and can be utilized in conjunction with other equipment to support and stabilize a building structure which has, or may experience, settlement or movement.

It is also understood that the connected piling sections described above, which can include the early screw anchor, can have applications other than the foundation lifting and support assembly described above. For example, they could be a part of a preconstruction support system for a building in which case a concrete slab would be poured over the connected piling sections and possible additional series of connected piling sections. Examples of this are disclosed in pending U.S. patent application Ser. Nos. 10/369,838 and 11/064,133, the disclosures of which are hereby incorporated by reference.

Also, the connected piling sections, which could include the earth screw anchor, could be part of a post construction alignment and anchoring system for buildings in which case they would extend from a wall of a building to support, stabilize, align, and/or anchor the wall. An example of this is disclosed in U.S. Pat. No. 6,931,805 the disclosure of which is hereby incorporated by reference.

It is understood that other variations may be made in the foregoing without departing from the scope of the invention, and examples of the variations are as follows:

The sections 62 and 64 of the piling 40 do not have to have a circular cross sections but can take other shapes such as rectangular, square, etc, in which case the outer surfaces of the fasteners 70 and 72 would be shaped accordingly.

The fastener 70 is not limited to those having a hexagonal outer surface, and it can be fastened to the interior of the piling section 62 by other techniques, such as by a threaded connection.

The outer surfaces of the fasteners 70 and 80, and the adapters 74 and 84, do not have to extend flush with the corresponding ends of the piling sections 62 and 64, respectively, but rather can extend in the sections a predetermined distance.

The sections 62 and 64 are not limited to piling sections, but could be in the form of any other type of tubular members such as pipes, conduits, etc. for transporting fluid, etc.

The raising and supporting system 10 of the present invention can also be used in an identical manner to raise a concrete slab extending underneath the entire area of a building or a house. In the case of a concrete slab, the system 10 would be mounted on an outer wall of the slab.

The clamping assembly 26 can be replaced with a block, or driving section that engages the upper end of the piling 40 and, when forced downwardly by the ram units 32*a* and 32*b*, drives the assembly into the ground.

An external drive system can be provided to drive the sleeve 25, and then the piling 40, into the ground until a predetermined resistance is encountered, after which the ram units 32*a* and 32*b* can be installed and activated to raise the foundation or slab in the manner described above.

Other types of elongated members, other than piling sections can be connected in the manner disclosed above.

Since other modifications, changes, and substitutions are intended in the foregoing disclosure, it is appropriate that the appended claims be construed broadly and in a manner consistent with the scope of the invention.

What is claimed is:

1. A lifting system including two piling sections comprising:

a lifting arm assembly;

means for moving the lifting arm assembly including a pair of relatively movable members;

means for moving the relatively movable members; and a piling assembly connected to be moved in response to the relative movement of the members, the piling assembly including;

a first connector member connected to one of the piling sections;

a second connector member connected to the other piling section; and the first and second connector members being directly connectable to connect the piling sections in an abutting, end-to-end relationship and further comprising:

the second connector member including a first portion having a first diameter and a second portion having a second diameter greater than the first diameter, the first portion being receivable by the first connector member.

2. The system of claim 1 wherein the first connector member is adapted to be welded to the corresponding inner end portion of one of the piling sections, and wherein the second portion of the second connector member is adapted to be welded to the corresponding inner end portion of one of the other piling sections.

3. The system of claim 2 wherein the first connector member has a maximum diameter that is less than the internal diameter of the one piling section so that it can be welded to the one piling section.

4. The system of claim 2 wherein the first connector member comprises an internally threaded bore, and the first portion of the second connector member further comprises an externally threaded section that is adapted to threadedly engage the internally threaded bore.

5. The system of claim 4 wherein the externally threaded section of the first portion is formed integrally with the second portion of the second connector member.

6. The system of claim 1 wherein each piling section has an internally threaded end portion that is threadedly engaged by a corresponding member.

7. The system of claim 6 wherein the first and second connector members comprise an externally threaded section adapted to threadedly engage the internally threaded end portion of each of the piling sections.

8. The system of claim 1 wherein at least one piling section includes a transversely-extending, load-bearing section including a helix, wherein the load-bearing section forms, with the piling sections, an assembly for cutting the earth when torsional and axial forces are applied to the assembly to drive the piling sections into the ground.

9. The system of claim 1 wherein the lifting arm assembly engages a surface of a foundation or slab, the lifting arm assembly including a support sleeve, through which one of the piling sections extends, and movement of the plates applies a load to the one piling section to drive a portion of the piling section into the ground.

10. The system of claim 1 wherein a concrete slab is formed over the connected piling sections to form a portion of a preconstruction support system for a building.

11. The system of claim 1 wherein the connected piling sections extend from a wall of a building to support, align, stabilize and/or anchor the wall.

* * * * *